US009155951B2

(12) United States Patent
Ahern

(10) Patent No.: US 9,155,951 B2
(45) Date of Patent: Oct. 13, 2015

(54) LACROSSE TRAINING AID

(71) Applicant: Daniel R. Ahern, Cohasset, MA (US)

(72) Inventor: Daniel R. Ahern, Cohasset, MA (US)

( * ) Notice: Subject to any disclaimer, the term of this patent is extended or adjusted under 35 U.S.C. 154(b) by 288 days.

(21) Appl. No.: 13/799,692

(22) Filed: Mar. 13, 2013

(65) Prior Publication Data

US 2013/0244814 A1 Sep. 19, 2013

Related U.S. Application Data

(60) Provisional application No. 61/612,549, filed on Mar. 19, 2012.

(51) Int. Cl.
*A63B 69/00* (2006.01)
*A63B 71/14* (2006.01)

(52) U.S. Cl.
CPC ..... *A63B 69/00* (2013.01); *A63B 69/0059* (2013.01); *A63B 71/143* (2013.01); *A63B 2209/10* (2013.01); *A63B 2243/005* (2013.01)

(58) Field of Classification Search
USPC ..... 473/446, 505, 512, 513; 2/159, 161.1; D29/113
See application file for complete search history.

(56) References Cited

U.S. PATENT DOCUMENTS

| | | | | |
|---|---|---|---|---|
| 1,106,708 | A * | 8/1914 | Hazard | 2/159 |
| 2,852,779 | A * | 9/1958 | Roessler | 2/161.2 |
| 3,365,108 | A | 1/1968 | Giba | |
| 3,372,401 | A * | 3/1968 | Woodward | 2/159 |
| 3,918,097 | A * | 11/1975 | Mlodoch | 2/161.1 |
| 3,951,416 | A | 4/1976 | Koch et al. | |
| 4,730,354 | A * | 3/1988 | Saito | 2/161.2 |
| 5,004,231 | A * | 4/1991 | Alread | 482/139 |
| 5,205,803 | A * | 4/1993 | Zemitis | 482/121 |
| 5,802,614 | A * | 9/1998 | Melone, Jr. | 2/161.1 |
| 5,867,830 | A * | 2/1999 | Chen | 2/161.1 |
| 6,035,442 | A * | 3/2000 | Marando | 2/161.1 |
| 6,223,353 | B1 | 5/2001 | Lardieri, Jr. | |
| 2004/0221365 | A1* | 11/2004 | Fitzgerald | 2/159 |
| 2008/0248899 | A1 | 10/2008 | Whitten et al. | |
| 2013/0244814 | A1* | 9/2013 | Ahern | 473/446 |
| 2013/0276207 | A1* | 10/2013 | Curl et al. | 2/163 |

* cited by examiner

*Primary Examiner* — Gene Kim
*Assistant Examiner* — M Chambers
(74) *Attorney, Agent, or Firm* — Lando & Anastasi LLP

(57) ABSTRACT

According to one aspect, embodiments of the invention provide a lacrosse training aid comprising at least one glove configured to be placed on the hand of a lacrosse player, the at least one glove comprising an integrated strap mechanism configured to couple the at least one glove to a lacrosse stick in a non-dominant configuration.

19 Claims, 2 Drawing Sheets

LACROSSE TRAINING AID

RELATED APPLICATION

This application claims priority under 35 U.S.C. §119(e) to U.S. Provisional Application No. 61/612,549, entitled "LACROSSE TRAINING AID," filed Mar. 19, 2012, which is hereby incorporated by reference in its entirety for all purposes.

BACKGROUND OF THE DISCLOSURE

1. Field of the Invention

Aspects of the present invention relate generally to lacrosse stick training.

2. Discussion of Related Art

Lacrosse is a team sport played using a small rubber ball and a long-handled stick called a lacrosse stick. The head of the lacrosse stick is strung with loose mesh designed to catch and hold the lacrosse ball and can also be strung with hard mesh. Many different types of mesh may be utilized such as Canadian mesh, rocket pocket and normal mesh. Offensively, the objective of the game is to score by shooting the ball into an opponent's goal, using the lacrosse stick to catch, carry, and pass the ball to do so. Defensively, the objective is to keep the opposing team from scoring and to dispossess them of the ball through the use of stick checking and body contact or positioning.

SUMMARY OF INVENTION

At least one aspect of the invention is directed to a lacrosse training aid comprising at least one glove configured to be placed on the hand of a lacrosse player, the at least one glove comprising a wrist portion configured to cover a wrist of the player when the hand of the player is inserted within the glove, an over hand area configured to be adjacent a top area of the hand of the player when the hand is inserted within the glove, an under hand area configured to be adjacent a bottom area of the hand of the player when the hand is inserted within the glove, the under hand area having a first area and a second area, a plurality of finger portions coupled to the over hand area and the under hand area, each one of the plurality of finger portions configured to cover a finger of the player when the hand of the player is inserted within the glove, a thumb portion coupled to the over hand area and the under hand area, the thumb portion configured to cover a thumb of the player when the hand of the player is inserted within the glove, and an integrated strap mechanism coupled between the first and second areas of the under hand area to form an opening between the integrated strap mechanism and the under hand area of the at least one glove, the integrated strap mechanism configured to restrain a lacrosse stick within the opening and couple the at least one glove to the lacrosse stick.

According to one embodiment, the first area of the under hand area is adjacent the wrist portion and the second area of the under hand area is adjacent one of the plurality of finger portions. In another embodiment, the first area of the under hand area is adjacent the thumb portion and the second area of the under hand area is adjacent one of the plurality of finger portions.

According to another embodiment, the wrist portion comprises an elastic strap. In another embodiment, the wrist portion comprises an adjustable hook and loop fastener strap.

According to one embodiment, the integrated strap mechanism is coupled to at least one of the first and second area of the under hand area with a hook and loop fastener. In another embodiment, the integrated strap mechanism is coupled to the at least one of the first and second area of the under hand area with stitching. In one embodiment, the integrated strap mechanism is further configured to allow the at least one glove to move independently along a shaft of the lacrosse stick while the lacrosse stick is restrained within the opening and coupled to the at least one glove.

According to another embodiment, the glove is comprised of nylon-knit material. In another embodiment, the integrated strap mechanism comprises an elastic strap. In one embodiment, the integrated strap mechanism further comprises a nylon-knit sleeve covering the elastic strap.

According to one embodiment, the lacrosse training aid further comprises at least one padded area. In one embodiment, the at least one padded area is comprised of at least one of leather, synthetic leather, and Ethylene-Vinyl Acetate (EVA) foam.

According to another embodiment, at least one of the thumb portion and the plurality of finger portions comprises at least one mesh gusset. In one embodiment, at least one of the plurality of finger portions comprises at least one mesh vent.

According to one embodiment, the at least one glove is one of a men's style lacrosse glove and a woman's style lacrosse glove. In another embodiment, the at least one glove comprises a first one of the at least glove configured to be placed on a non-dominant hand of the lacrosse player and a second one of the at least one glove configured to be placed on a dominant hand of the lacrosse player, wherein the first one of the at least one glove is configured to be coupled to the lacrosse stick at a first area of the lacrosse stick and the second one of the at least one glove is configured to be coupled to the lacrosse stick at a second area of the lacrosse stick, and wherein the first area is closer to a head of the lacrosse stick then the second area.

Another aspect of the invention is directed to lacrosse training aid comprising at least one glove configured to be placed on the hand of a lacrosse player, and means for coupling the at least one glove to a lacrosse stick in a non-dominant configuration.

According to one embodiment, the means for coupling comprises means for decoupling the glove and the lacrosse stick in response to an abnormal condition. In another embodiment, the means for coupling is configured to allow the glove to move independently along a shaft of the lacrosse stick while the lacrosse stick is coupled to the glove.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1B:
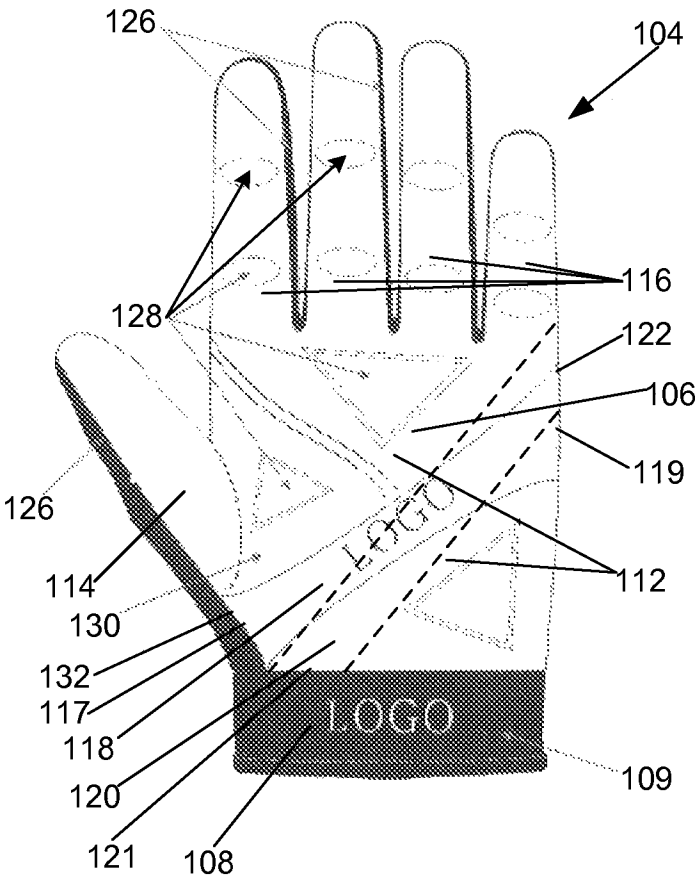
FIG. 1B illustrates an under hand view of a lacrosse training aid according to aspects of the current invention.

Various embodiments and aspects thereof will now be discussed in detail with reference to the accompanying drawings. It is to be appreciated that this invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Lacrosse players typically have a dominant hand and a non-dominant hand. For example, a right handed player is typically dominant on their right side and non-dominant on their left side. The tendency is for a player's dominant hand to hold a lacrosse stick closest to the head of the lacrosse stick (i.e., at the top of the lacrosse stick), while the non-dominant hand holds the stick closest to the butt end of the lacrosse stick (i.e., at the bottom of the lacrosse stick). It is typically more difficult and unnatural for the player to alternate the positioning of their dominant and non-dominant hands (i.e., locate their non-dominant hand closest to the head of the lacrosse stick and their dominant hand closest to the butt end of the lacrosse stick). As such, lacrosse players may have a natural tendency to favor or revert back to their dominant side while avoiding their off-hand or non-dominant side.

Embodiments described herein provide a lacrosse training aid that promotes and accelerates skill development, proficiency and muscle-memory of the player's non-dominant side. The lacrosse training aid described herein attempts to address one of the most glaring weaknesses among youth, middle school, high school and even college level players—the lack of proficient two-handed play. For lacrosse players to achieve elite status in the sport, seamless and complete two-handed play may be desired from as early as grade 5 and up.

Figure 1A:
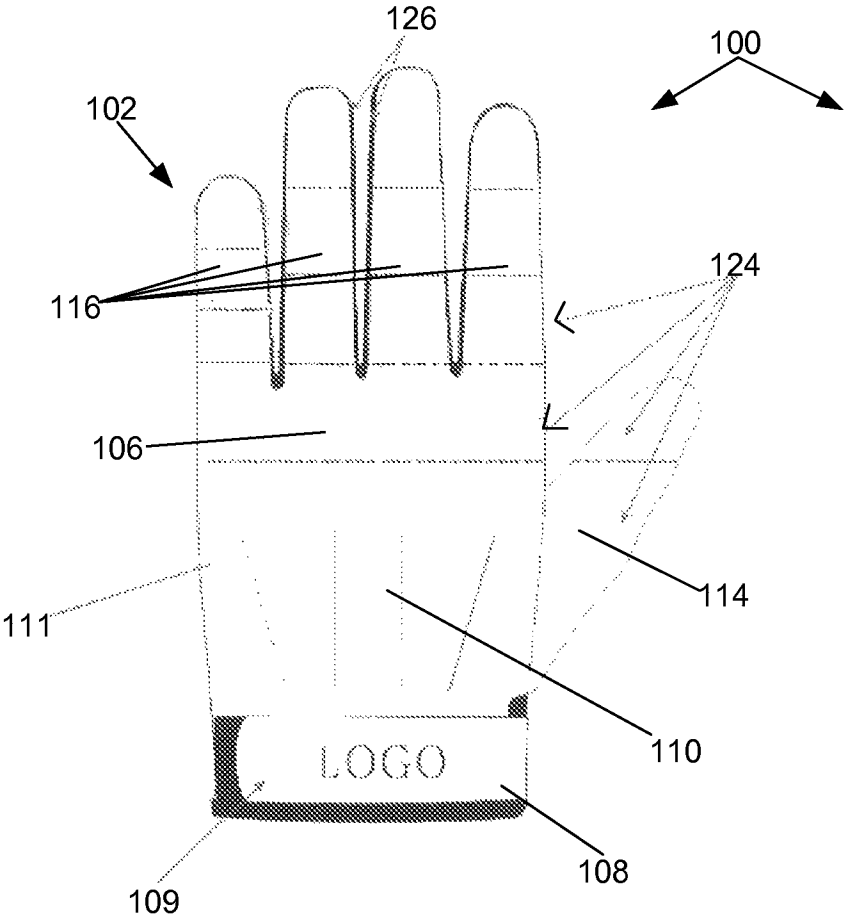
FIG. 1A illustrates an over hand view of a lacrosse training aid according to aspects of the current invention.

FIGS. 1A and 1B illustrate a lacrosse training aid 100. FIG. 1A illustrates an over hand view 102 of the lacrosse training aid 100. FIG. 1B illustrates an under hand view 104 of the lacrosse training aid 100.

As seen in FIGS. 1A and 1B the lacrosse training aid 100 includes a glove 106. According to one embodiment, the glove 106 is a boy's or men's style lacrosse glove. In another embodiment, the glove 106 is a girl's or woman's style lacrosse glove. In one embodiment, the glove 106 is an adult sized glove. In another embodiment, the glove 106 is a child sized glove. In other embodiments, the glove 106 may be any other type of lacrosse glove. According to one embodiment, the glove 106 is a nylon-knit glove; however, in other embodiments, any other appropriate material (e.g., such as leather) may be used.

The glove 106 includes a wrist portion 108, an over hand area 110, an under hand area 112, a thumb portion 114, a plurality of finger portions 116, and an integrated strap mechanism 118. The wrist portion 108 is coupled to both the over hand area 110 and the under hand area 112. The plurality of finger portions 116 and the thumb portion 114 are coupled to the over hand area 110 and under hand area 112.

The integrated strap mechanism 118 is coupled from one area of the under hand area 112 to another area of the under hand area 112 to form an opening between the integrated strap mechanism 118 and the under hand area 112. For example, according to one embodiment, the integrated strap mechanism 118 is coupled between an area 117 of the under hand area 112 adjacent the thumb portion 114 and an area 119 of the under hand area 112 adjacent one of the plurality of finger portions 116. According to another embodiment, the integrated strap mechanism 120 (illustrated with dashed lines) is coupled between an area 121 of the under hand area 112 adjacent the wrist portion 108 and another area 122 of the under hand area 112 adjacent one of the plurality of finger portions 116.

The glove 106 is configured such that when a user's hand is inserted into the glove 106 via an opening at the wrist portion 108, the user's hand is encompassed by the glove 106. When the user's hand is within the glove 106, the wrist portion 108 surrounds the wrist of the user. According to one embodiment, the wrist portion 108 is comprised of nylon-knit material; however, in other embodiments, the wrist portion 108 may be comprised of another appropriate material. In another embodiment, the wrist portion 108 is elastic and configured to hold the wrist portion 108 against the wrist of the user. According to another embodiment, the wrist portion 108 includes an adjustable hook and loop (e.g., Velcro) wrist strap 109. In such an embodiment, a user may utilize the hook and loop wrist strap 109 to tighten the wrist strap 109 around the wrist of the user and lock the wrist strap 109 in the tightened configuration.

When the user's hand is within the glove 106, the over hand area 110 is configured to be adjacent the top area of the user's hand. According to one embodiment, the over hand area 110 comprises ventilated mesh 111; however, in other embodiments, the over hand area 100 may include other appropriate materials.

When the user's hand is within the glove 106, the thumb portion 114 is configured to encompass the thumb of the user and each one of the plurality of finger portions 116 is configured to encompass a finger of the user. According to one embodiment, both the plurality of finger portions 116 and the thumb portion 114 include padding 124 which is configured to be located at the joints of the user's hand (e.g., at the major and/or minor knuckles) when the user's hand is within the glove 106. In another embodiment, the thumb portion 114 includes the padding 124 at a tip of the thumb portion 114. According to one embodiment, the padding 124 is comprised of Ethylene-Vinyl Acetate (EVA) foam; however, in other embodiments, the padding 124 may be comprised of another appropriate material such as leather or synthetic leather.

According to one embodiment, both the plurality of finger portions 116 and the thumb portion 114 include mesh gussets 126 to provide ventilation. According to another embodiment, the plurality of finger portions 116 include mesh vents 128 to provide additional ventilation.

When the user's hand is within the glove 106, the under hand area 112 is configured to be adjacent the bottom area of the user's hand (i.e. the user's palm). According to one embodiment, the under hand area 112 includes padding. For example, in one embodiment, the under hand area 112 includes leather padding. In another embodiment, the under hand area 112 includes synthetic leather padding. However, in other embodiments, the padding of the under hand area 112 may be made of other appropriate materials such as EVA foam. According to one embodiment, the under hand area 112 also includes mesh vents 128 to provide ventilation.

Figure 2:
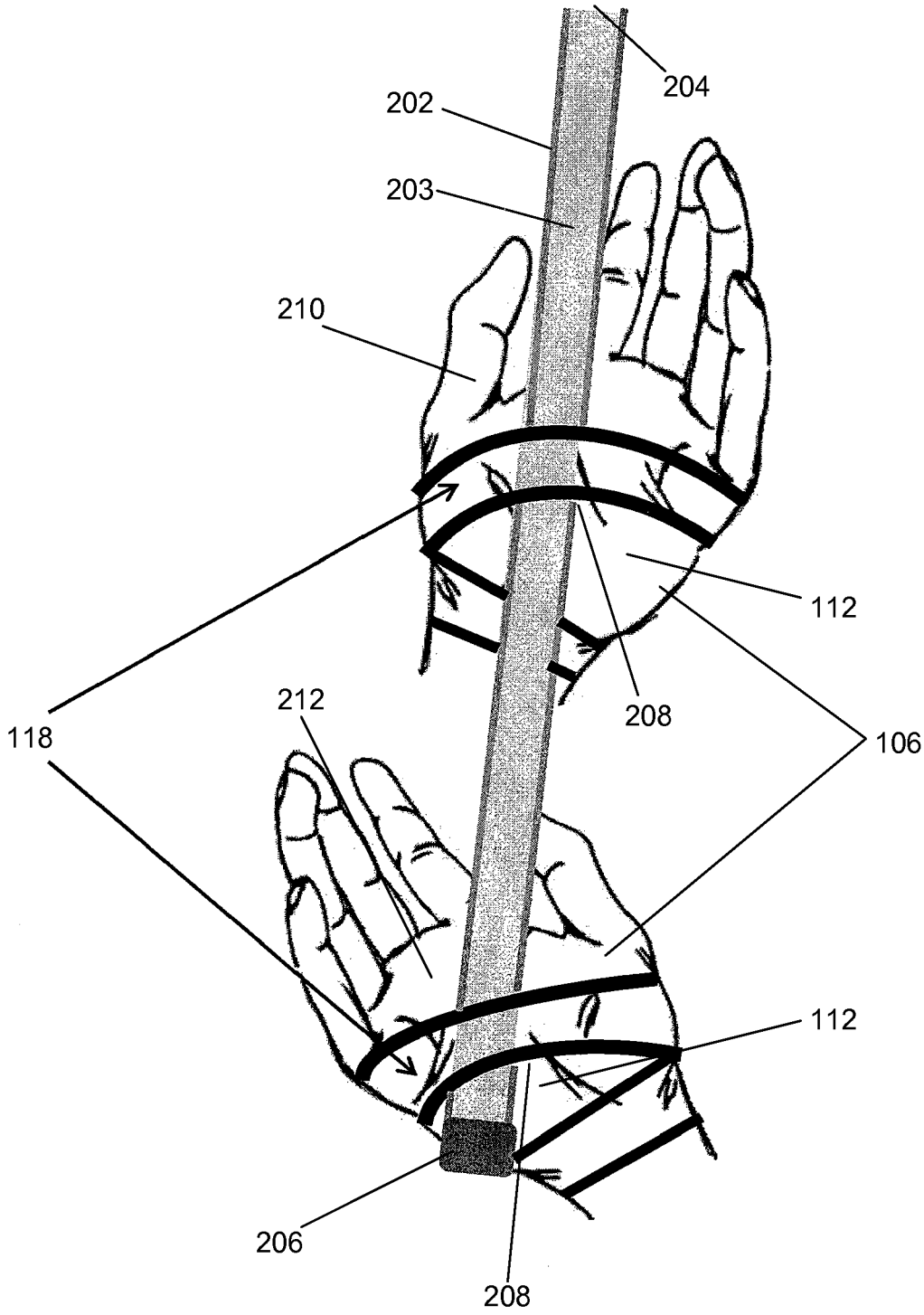
FIG. 2 illustrates the use of a lacrosse training aid according to aspects of the current invention.

Upon inserting his or her hand within the glove 106 or prior to inserting his or her hand within the glove 106, the user may couple the glove 106 to a lacrosse stick for non-dominant side training. For example, FIG. 2 illustrates the use of a pair of gloves 106 with a lacrosse stick 202. The lacrosse stick 202 has a shaft 203, a first end 204 closest to the head (not shown), and a second end 206 farthest from the head.

The shaft 203 of the lacrosse stick is inserted through an opening 208 formed between the integrated strap mechanism 118 and the under hand area 112 of each glove 106. According to one embodiment the integrated strap mechanism 118 is an elastic strap configured to restrain the shaft 203 of the lacrosse stick 202 within the opening 208 and against the under hand area 112 of the glove 106 when the shaft 203 is inserted between the integrated strap mechanism 118 and the under hand area 112. In other embodiments, the integrated strap mechanism 118 may be composed of any appropriate material capable of restraining the user's hand to the shaft 203. According to one embodiment, the elastic strap integrated strap mechanism 118 is covered by a reinforced nylon-knit sleeve; however, in other embodiments, the integrated strap mechanism 118 may be covered by any type of material.

The integrated strap mechanism 118 is configured to restrain the hands or grip of a lacrosse player to the stick 202 (i.e. within the opening 208) in a non-dominant orientation. For example, as shown in FIG. 2, ideally for non-dominant training, the hand 210 closer to the first end 204 of the stick 202 (i.e. closer to the head of the stick 202) is the non-dominant hand of the lacrosse player and the hand 212 closer to the second end 206 of the stick 202 is the dominant hand of the lacrosse player. By restraining the hands or grip to the stick in this non-dominant orientation (i.e. with the integrated strap mechanisms 118), the lacrosse player may be forced to develop their off-hand or non-dominant stick skills.

According to one embodiment, the integrated strap mechanism 118 of each glove 106 allows each hand 210, 212 or grip (i.e., both the right and left-handed glove) to move up and down the shaft 203 of the lacrosse stick 202 independently; however, only while maintaining the non-dominant orientation of the top hand 210 and bottom hand 212 in their respective positions along the stick 202 (e.g., non-dominant hand on top and dominant hand on the bottom).

According to one embodiment, the integrated strap mechanism is coupled to the under hand area of the glove 106 with stitching. However, in another embodiment the integrated strap mechanism is coupled to the under hand area 112 of the glove 106 with a hook and loop fastener. For example, with regards to FIG. 1, the integrated strap mechanism 118 may be coupled to the area 117 of the under hand area 112 adjacent the thumb portion 114 with a hook and loop fastener 132. While a lacrosse stick 202 is restrained within the opening 208 against the under hand area 112 of the glove 106 and the user of the lacrosse stick 202 is using the stick 202 for non-dominant side training under normal conditions, the hook and loop fastener 132 maintains the coupling between the integrated strap mechanism 118 and the under hand area 112 of the glove 106.

However, if the stick 202 is subject to abnormal conditions (e.g., a force is applied to the stick 202 in such a way that maintaining the coupling between the integrated strap mechanism 118 and the under hand area 112 of the glove 106 may injure the user of the stick 202), the force may be strong enough to overcome the hook and loop fastener 132, causing the integrated strap mechanism 118 to separate from the under hand area 112 of the glove 112 and allowing the user to separate his or her hand from the stick 202 prior to injury.

As described above, both hands 210, 212 of a lacrosse player are restrained to the lacrosse stick 202; however, in another embodiment, only one hand of a lacrosse player may be restrained to a stick with an integrated strap mechanism of a single glove 106.

As described above, the lacrosse training aid 100 is implemented with younger age and less experienced lacrosse players; however, in other embodiments, the lacrosse training aid may be used by any age lacrosse player at any skill level.

According to one embodiment, the training aid is designed to accommodate either right-handed or left-handed players.

Utilizing the lacrosse training aid 100 during interactive training sessions, a player may be forced to develop non-dominant lacrosse stick skills including, passing, receiving a pass, shooting, cradling, dodging, scooping ground balls, defending and checking. By forcing a lacrosse player to play to their off-hand (i.e. with their non-dominant hand on top) the player is forced to go against their natural tendency to favor or revert back to their dominant side. Therefore, the lacrosse training aid described above promotes and accelerates skill development, proficiency and muscle-memory of the player's non-dominant side.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A lacrosse training aid in combination with a lacrosse stick, the lacrosse training aid comprising:

a first glove and a second glove, each glove configured to be placed on a hand of a lacrosse player, and each glove comprising:

a wrist portion configured to cover a wrist of the player when a hand of the player is inserted within the glove;

an over hand area configured to be adjacent a top area of the hand of the player when the hand is inserted within the glove;

an under hand area configured to be adjacent a bottom area of the hand of the player when the hand is inserted within the glove, the under hand area having a first area and a second area;

a plurality of finger portions coupled to the over hand area and the under hand area, each one of the plurality of finger portions configured to cover a finger of the player when the hand of the player is inserted within the glove;

a thumb portion coupled to the over hand area and the under hand area, the thumb portion configured to cover a thumb of the player when the hand of the player is inserted within the glove; and an integrated strap mechanism coupled between the first and second areas of the under hand area to form an opening between the integrated strap mechanism and the under hand area of the glove, the integrated strap mechanism configured to restrain a shaft of the lacrosse stick within the opening and slidably couple the glove to the shaft of the lacrosse stick, wherein while slidably coupled to the shaft of the lacrosse stick, the first glove is configured to move between a first end of the shaft and the second glove and the second glove is configured to move between a second end of the shaft and the first glove, wherein the integrated strap mechanism of the first glove is further configured, while restraining the shaft within the opening, to prevent movement of the first glove from overlapping movement of the second glove, and wherein the integrated strap mechanism of the second glove is further configured, while restraining the shaft within the opening, to prevent movement of the second glove from overlapping movement of the first glove.

2. The lacrosse training aid of claim 1, wherein the integrated strap mechanism comprises an elastic strap.

3. The lacrosse training aid of claim 2, wherein the integrated strap mechanism further comprises a nylon-knit sleeve covering the elastic strap.

4. The lacrosse training aid of claim 1, further comprising at least one padded area.

5. The lacrosse training aid of claim 4, wherein the at least one padded area is comprised of at least one of leather, synthetic leather, and Ethylene-Vinyl Acetate (EVA) foam.

6. The lacrosse training aid of claim 1, wherein at least one of the thumb portion and the plurality of finger portions comprises at least one mesh gusset.

7. The lacrosse training aid of claim 1, wherein at least one of the plurality of finger portions comprises at least one mesh vent.

8. The lacrosse training aid of claim 1, wherein the at least one glove comprises a first one of the at least glove configured to be placed on a non-dominant hand of the lacrosse player and a second one of the at least one glove configured to be placed on a dominant hand of the lacrosse player, wherein the first one of the at least one glove is configured to be coupled to the lacrosse stick at a first area of the lacrosse stick and the second one of the at least one glove is configured to be coupled to the lacrosse stick at a second area of the lacrosse stick, and wherein the first area is closer to a head of the lacrosse stick then the second area.

9. The lacrosse training aid of claim 1, wherein the first area of the under hand area is adjacent the wrist portion and the second area of the under hand area is adjacent one of the plurality of finger portions.

10. The lacrosse training aid of claim 1, wherein the first area of the under hand area is adjacent the thumb portion and the second area of the under hand area is adjacent one of the plurality of finger portions.

11. The lacrosse training aid of claim 1, wherein the wrist portion comprises an elastic strap.

12. The lacrosse training aid of claim 1, wherein the wrist portion comprises an adjustable hook and loop fastener strap.

13. The lacrosse training aid of claim 1, wherein the integrated strap mechanism is coupled to at least one of the first and second area of the under hand area with a hook and loop fastener.

14. The lacrosse training aid of claim 1, wherein the integrated strap mechanism is coupled to the at least one of the first and second area of the under hand area with stitching.

15. The lacrosse training aid of claim 1, wherein the integrated strap mechanism is further configured to allow the at least one glove to move independently along a shaft of the lacrosse stick while the lacrosse stick is restrained within the opening and coupled to the at least one glove.

16. The lacrosse training aid of claim 1, wherein the glove is comprised of nylon-knit material.

17. A lacrosse training aid in combination with a lacrosse stick, the lacrosse training aid comprising:

a first glove and a second glove configured to be placed on the hand of a lacrosse player; and means for coupling the first glove and the second glove to the lacrosse stick in a non-dominant configuration such that while slidably coupled to a shaft of the lacrosse stick, the first glove is configured to move between a first end of the shaft and the second glove and the second glove is configured to move between a second end of the shaft and the first glove, wherein the means for coupling is configured to prevent movement of the first glove from overlapping movement of the second glove while the first glove is slidably coupled to the shaft of the lacrosse stick, and wherein the means for coupling is further configured to prevent movement of the second glove from overlapping movement of the first glove while the second glove is slidably coupled to the shaft of the lacrosse stick.

18. The lacrosse training aid of claim 17, wherein the means for coupling comprises means for decoupling the glove and the lacrosse stick in response to an abnormal condition.

19. The lacrosse training aid of claim 17, wherein the means for coupling is configured to allow the glove to move independently along a shaft of the lacrosse stick while the lacrosse stick is coupled to the glove.

* * * * *